US008727083B2

(12) United States Patent
Lai

(10) Patent No.: US 8,727,083 B2
(45) Date of Patent: May 20, 2014

(54) FIBERGLASS FRAME

(76) Inventor: Chu Shan Lai, Xinzhuang (TW)

( * ) Notice: Subject to any disclaimer, the term of this patent is extended or adjusted under 35 U.S.C. 154(b) by 277 days.

(21) Appl. No.: 13/117,604

(22) Filed: May 27, 2011

(65) Prior Publication Data

US 2012/0024649 A1 Feb. 2, 2012

(30) Foreign Application Priority Data

Jul. 27, 2010 (CN) ..... 2010 2 02729795 U

(51) Int. Cl.
*A45C 13/00* (2006.01)

(52) U.S. Cl.
USPC ..... 190/24; 135/909

(58) Field of Classification Search
USPC ..... 190/24, 122, 127; 403/169; 135/909
See application file for complete search history.

(56) References Cited

U.S. PATENT DOCUMENTS 3,424,178 A * 1/1969 Yazaki ..... 135/157
3,461,539 A * 8/1969 Napple ..... 29/461
5,056,695 A * 10/1991 Giblet ..... 224/484
5,393,079 A * 2/1995 Wang ..... 280/37
5,499,702 A * 3/1996 Wang ..... 190/115
5,653,319 A * 8/1997 Wang ..... 190/115
6,131,713 A * 10/2000 Sher ..... 190/122
6,279,877 B1 * 8/2001 Davis ..... 254/134.3 FT
2003/0075923 A1 * 4/2003 Lepoutre ..... 285/330
2006/0283492 A1 * 12/2006 Livacich et al. ..... 135/95
2009/0242344 A1 * 10/2009 Selvi ..... 190/18 A

* cited by examiner

*Primary Examiner* — Sue A Weaver
(74) *Attorney, Agent, or Firm* — Muncy, Geissler, Olds & Lowe, P.C.

(57) ABSTRACT

A fiberglass frame, serving as trunk frame, and including round rods, connection pieces, lateral rods, a handle rack and fastening pieces. The connection piece is provided with three connection ends, and each connection end is provided with an insertion slot. The round rod is inserted into the insertion slot in the connection piece to form a frame with the connection piece. The handle rack is located on a side of the frame and is provided with an upper fixing stand and a lower fixing stand, such that the upper fixing stand is connected to two the connection pieces on two sides through an upper lateral rod. The lower lateral rod runs through the lower fixing stand and is connected to two the connection pieces on two sides.

6 Claims, 7 Drawing Sheets

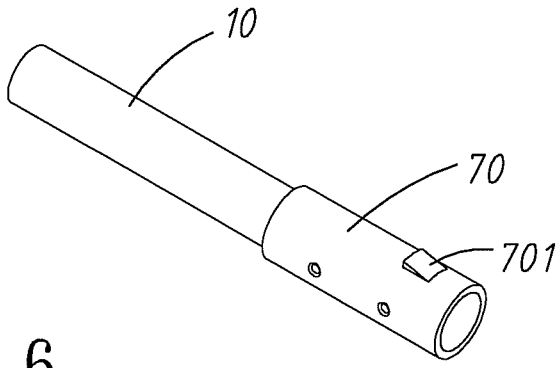
Fig. 6
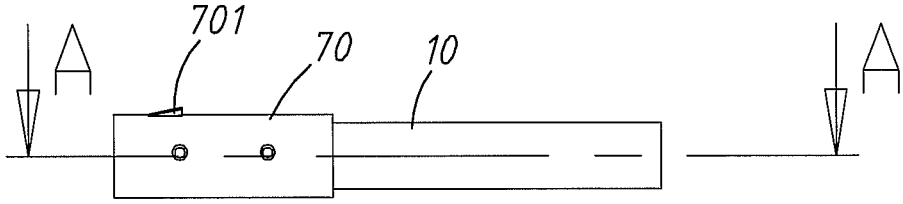
Fig. 7
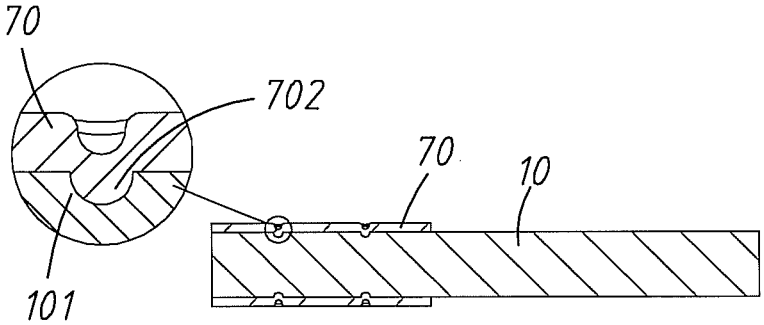
Fig. 8a
Fig. 8

FIBERGLASS FRAME

BACKGROUND OF THE INVENTION

1. Field of the Invention

The present invention relates to a luggage trunk frame, and in particular to a luggage trunk frame made of fiberglass.

2. The Prior Arts

Presently on the market, most of the trunk frames are made of plate-shaped rod racks assembled through utilizing screws. Yet the frame assembly and detachment is tedious, and the material utilized is heavy, hereby resulting in heavy weight of the overall luggage trunk. In addition, since this frame is made of twelve rod racks, having longer length of rod racks in the vertical direction, thus it tends to deform under external force.

Therefore, presently, the design and performance of the conventional trunk frame is not quite satisfactory, and it has much room for improvement.

SUMMARY OF THE INVENTION

In view of the shortcomings and drawbacks of the prior art, the present invention provides a fiberglass frame to be used in a luggage trunk, so as to overcome the problems of the prior art.

A major objective of the present invention is to provide a fiberglass frame, having three connection ends formed integrally as a connection piece, so that the assembly and detachment of the frame is easy and convenient.

Another objective of the present invention is to provide a fiberglass frame, with its sides fastened with lateral rods, so that the frames are not easy to deform, hereby increasing its rigidity.

A yet another objective of the present invention is to provide a fiberglass frame, wherein, a fixing plate is sleeved onto the round rod ends connected to the connection piece, so that the round rod and the connection piece can be more stably connected.

In order to achieve the above-mentioned objective, the present invention provides a fiberglass frame to be used as trunk frame, including: round rods, connection pieces, lateral rods, a handle rack, and fastening pieces. The connection piece is provided with three connection ends thereon, and an insertion slot is provided in the end. The round rod is inserted into the insertion slot in the connection piece, to form a frame jointly with the connection piece. The handle rack is located on a side of the frame, and an upper fixing stand and a lower fixing stand are provided on the handle rack, such that the upper fixing stand is connected to the two connection pieces on two sides through an upper lateral rod, and a lower lateral rod runs through the lower fixing stand, and is connected to the two connection pieces on two sides. Moreover, lateral rods are provided on the side of the frame, so that the lateral rod is sandwiched and fastened between two round rods by means of a fastening piece.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which:

FIG. 6 is a perspective view of the assembled fixing plate and round rod according to the present invention;

FIG. 7 is a side view of FIG. 6 of the assembled fixing plate and round rod according to the present invention; and FIG. 8 is a cross section view along AA line of FIG. 7 according to the present invention and FIG. 8*a* is a partial enlargement view of FIG. 8.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
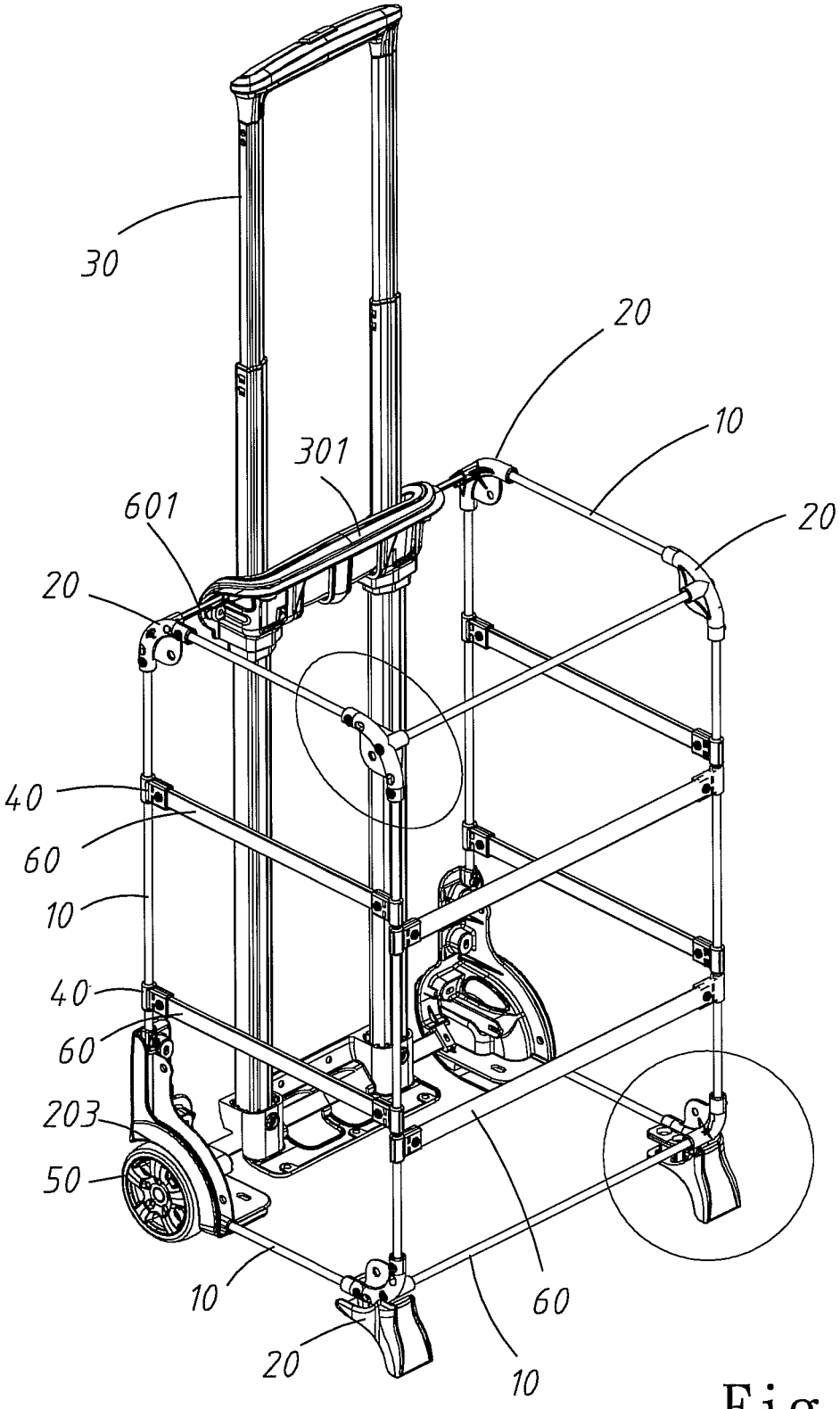
FIG. 1 is a perspective view of the fiberglass frame according to the present invention.
Figure 1A:
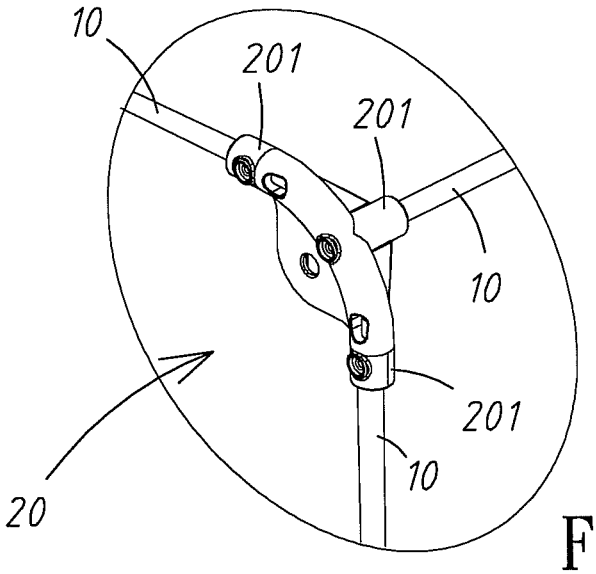
FIG. 1*a* is an enlarged view of the connection piece of the fiberglass frame according to the present invention.
Figure 1B:
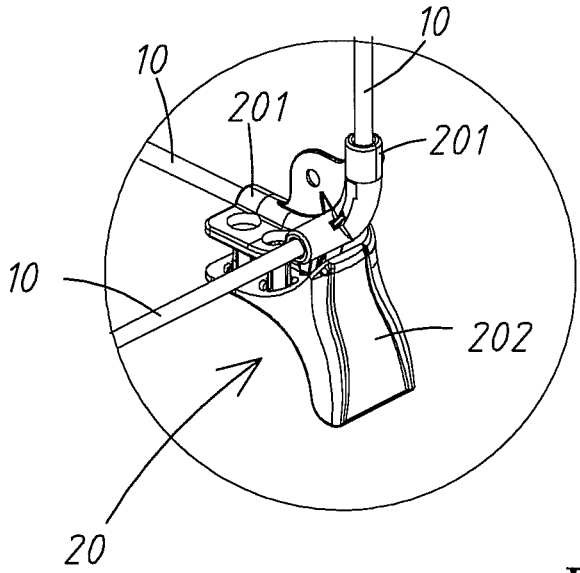
FIG. 1*b* is an enlarged view of a connection piece having footing of the fiberglass frame according to the present invention.
Figure 2:
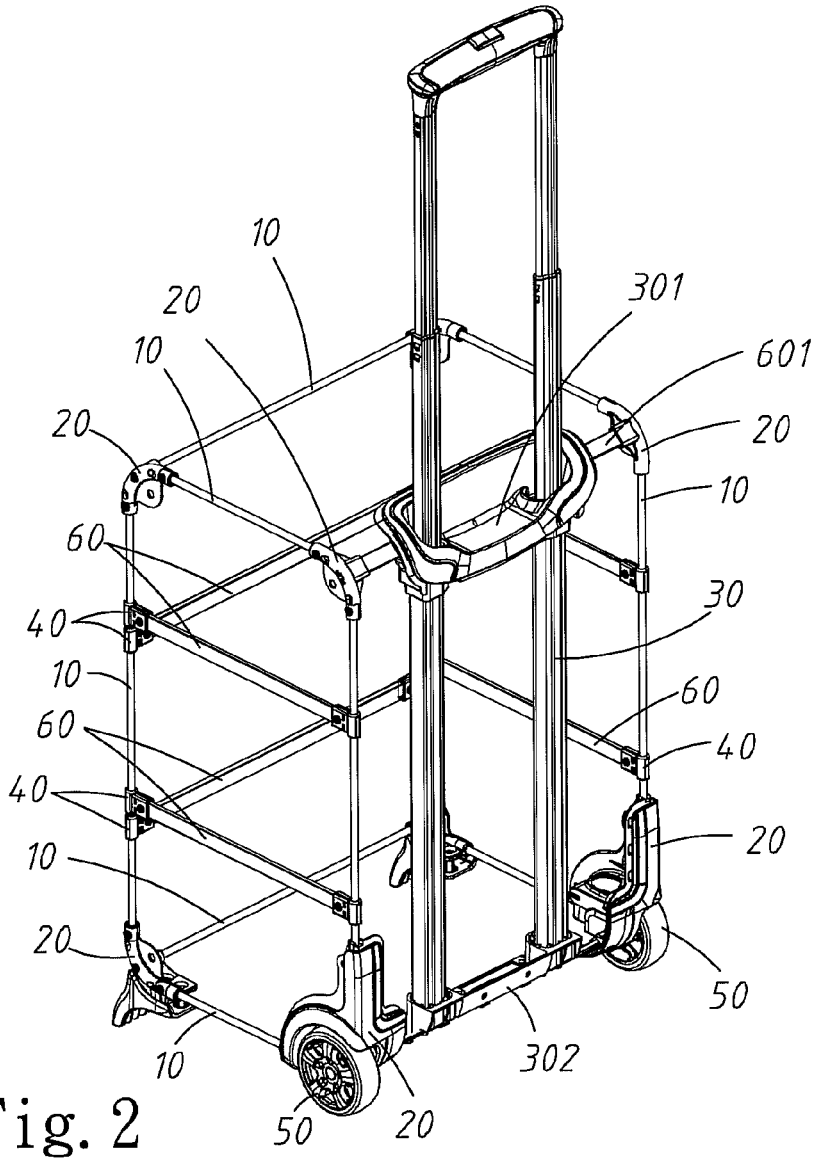
FIG. 2 a perspective view of the fiberglass frame viewed from another angle according to the present invention.
Figure 2A:
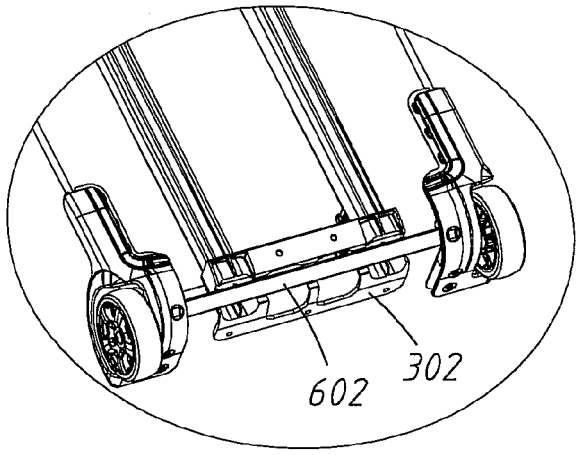
FIG. 2*a* is a partial enlargement view of FIG. 2 according to the present invention.
Figure 3:
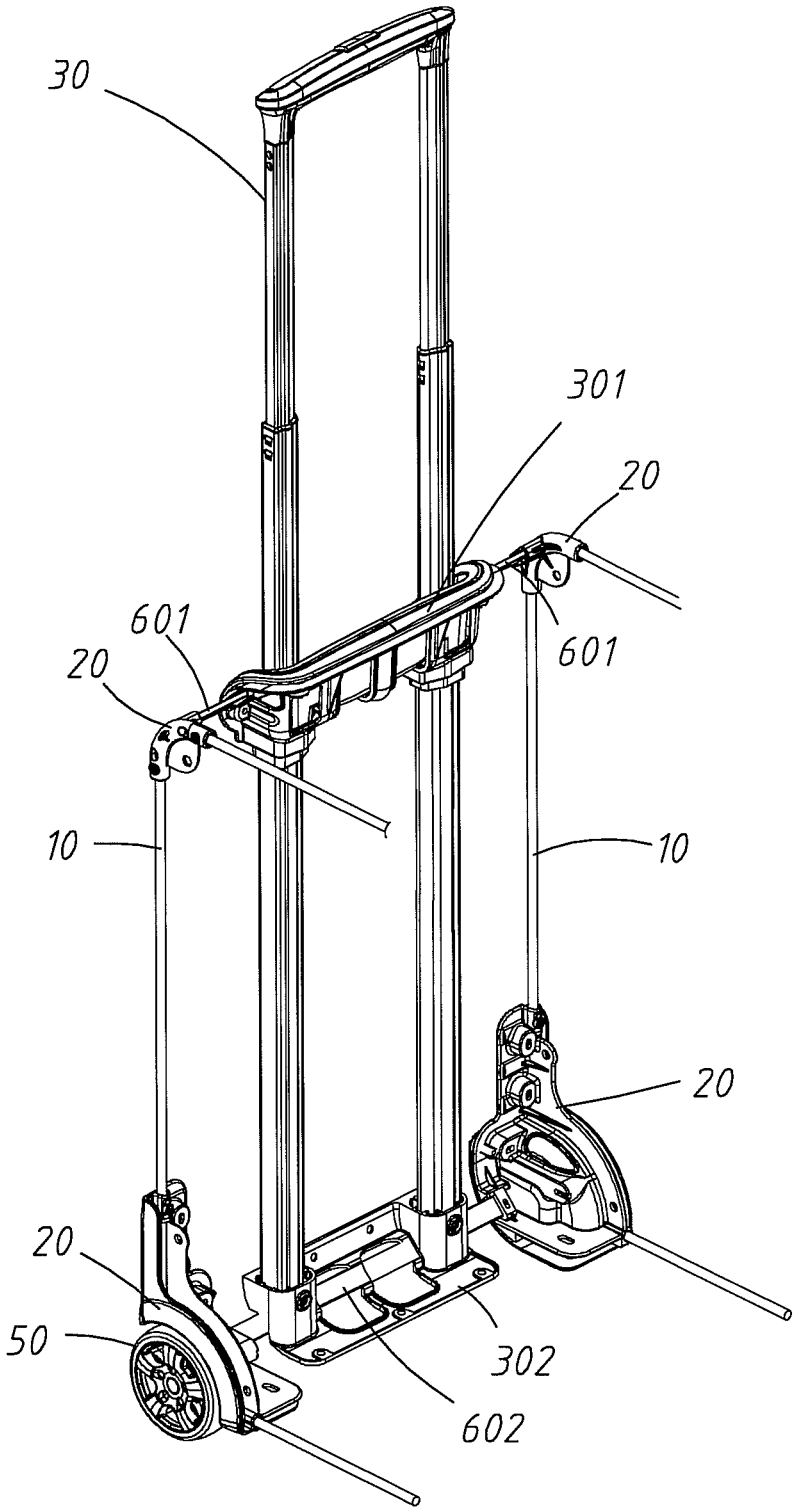
FIG. 3 is a schematic diagram of a partial structure of the fiberglass frame according to the present invention.
Figure 4:
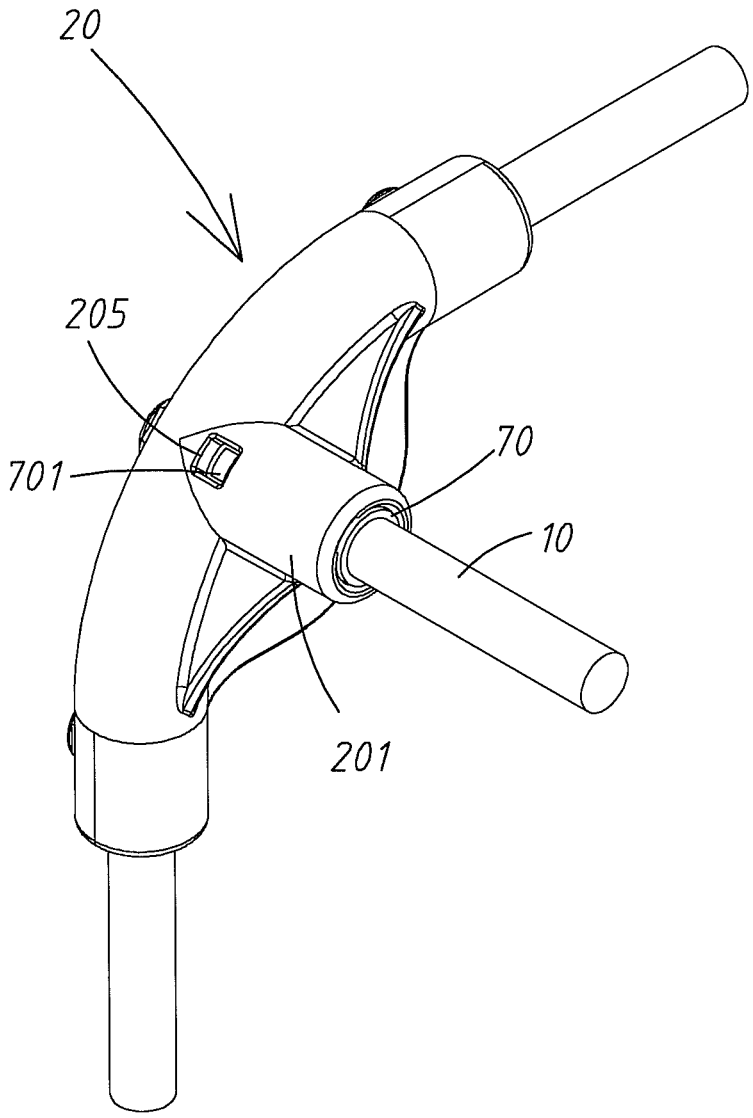
FIG. 4 is a perspective view of the assembled connection piece, fixing plate, and round rod.
Figure 5:
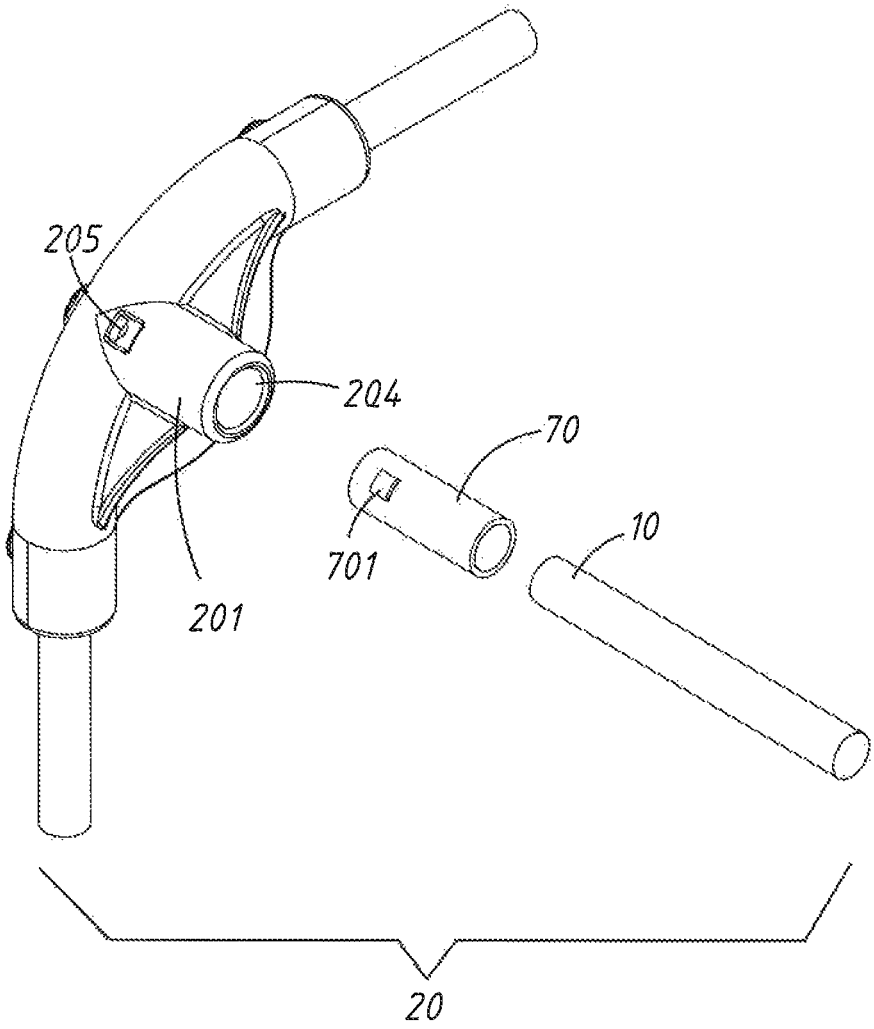
FIG. 5 is an exploded view of the elements in FIG. 4 according to the present invention.

FIGS. 1 to 3 are perspective view and partial enlarged view of fiberglass frame according to the present invention. As shown in FIGS. 1 to 3, the fiberglass frame is used as a frame in a luggage trunk, comprising: round rods 10, connection pieces 20, lateral rods 60, a handle rack 30, and fastening pieces 40. On the connection piece 20 is provided with three connection ends 201 perpendicular to each other and formed integrally into a piece. Each end 201 is provided with an insertion slot for the round rod 10 or lateral rod 60 to be inserted therein. The round rod 10 is made of light weight material such as fiberglass or carbon fiber, so as to reduce the overall weight of the frame, and for being easy to be dragged along. The round rod 10 is inserted into the insertion slot of the connection piece 20, so as to form a cuboid-shaped frame jointly with the connection pieces 20. The handle rack 30 is located on one side of the frame, and is provided with an upper fixing stand 301 and a lower fixing stand 302. Two ends of the upper lateral rods 601 are inserted into the insertion slot of the upper fixing stand 301, and the insertion slot in the connection piece 20 on both sides of the upper fixing stand 301 respectively, thus realizing the connection of the upper fixing stand 301 and the two connection pieces 20 on both sides. The lower lateral rod 602 passes through the lower fixing stand 302, with its two ends inserted into the insertion slots of the two connection pieces 20 on both sides of the lower fixing stand 302, hereby realizing the connection of the lower fixing stand 302 and the two connection pieces 20 on both sides (refer to FIG. 3), as such fixing the handle rack 30 on the sides. The two connection pieces 20 on both sides of the lower fixing stand 302 are provided with arc-shaped dent slot 203, which is used to accommodate rollers 50 to rotate in the slot. On the other two connection pieces 20 at the bottom plane are provided with footings 202. The lowest point of the two footings 202 together with the lowest points of the two rollers 50 constitute a horizontal plane, so that the frame may erect stably thereon. On the erected round rods 10 are provided with fastening pieces 40, and a lateral rod 60 is sandwiched and fastened between the fastening pieces 40 on two adjacent round rods 10, to enhance the rigidity of the frame. Since the vertical length of the erected round rod 10 is rather long, thus it is liable to deform under pressure, therefore, the lateral rod 60 sandwiched and fastened in-between may prevent it from deforming. The fastening pieces 40 can be moved upward and downward along the round rods 10 to adjust the position of the lateral rods 60, so that the lateral rods 60 can be moved upward and downward to find a better position to achieve rigidity of the frame. As such, realizing an integral structure for various components of the fiberglass frame, that is rigid in structure and convenient in assembly and detachment.

In the present embodiment, the shape of frame assembled can be a cube, a cuboid, or an irregular shape.

In addition, refer to FIGS. 4 to 8, with their main purpose to enhance the connection strength of the round rod and connection piece. As shown in FIGS. 4 to 8, the fiberglass frame of the present invention further includes a sleeve-shaped fixing plate 70, sleeved around one end of the round rod 10. On the outer perimeter of the fixing plate 70 is provided with a barb 701, and on each connection end 201 of the connection piece 20 is provided with a fastening slot 205 in communication with the insertion slot 204 of the connection end 201. When the round rod 10 sleeved with fixing plate 70 is inserted into the insertion slot 204 of the connection end 201, it can achieve more stable connection through fastening and connecting a barb 701 of the fixing plate 70 to the fastening slot 205.

Moreover, mutual positioning pieces are further provided between the fixing plate 70 and the round rod 10. For example, as shown in FIG. 8, on the outer surface of the round rod 10 is provided with a positioning slot 101, and the inner surface of the fixing plate 70 is provided with positioning protrusion block 702, so as to achieve positioning of round rod 10 and the fixing plate 70 through matching positioning slot 101 with positioning protrusion block 70, hereby avoiding relative movement or rotation between round rod 10 and fixing plate 70, as shown in FIG. 8*a*.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A fiberglass frame, serving as trunk frame, comprising: round rods; connection pieces; lateral rods; a handle rack; and fastening pieces; wherein, on said connection piece is provided with three connection ends, and each of said connection end is provided with an insertion slot; said round rod is inserted into said insertion slot in said connection piece, to form a frame with said connection piece; said handle rack is located on a side of said frame, and is provided with an upper fixing stand and a lower fixing stand, such that said upper fixing stand is connected to two of said connection pieces on two sides through an upper lateral rod, and a lower lateral rod runs through said lower fixing stand, and is connected to two said connection pieces on two sides; said lateral rods are provided on two sides of said frame, and said fastening piece is used to sandwich and fasten said lateral rod between two of said round rods; and wherein each of said round rods is further sleeved with a fixing plate, an outer surface of said fixing plate is provided with a barb, and an inner surface of said fixing plate is provided with at least a positioning protrusion block; wherein a fastening slot is provided at said connection end of said connection pieces, and through fastening and connecting said barb with said fastening slot, said round rod and said connection piece are more stably connected; and wherein an outer surface of said round rod is provided with at least positioning slot, hereby achieving positioning said round rod and said fixing plate through matching ad positioning slot with said positioning protrusion block,

2. The fiberglass frame as claimed in claim 1, wherein two of said connection pieces on both sides of said lower fixing stand are provided with arc-shaped dent slots, that are used to accommodate rollers to rotate in said dent slot, and on other two of said connection pieces at a bottom plane are provided with footings.

3. The fiberglass frame as claimed in claim 1, wherein shape of said frame assembled is a cube, a cuboid, or an irregular shape.

4. A fiberglass frame, serving as trunk frame, comprising:

a plurality of round rods;

a plurality of connection pieces, provided with three connection ends thereon, and each of said connection end is provided with an insertion slot, said round rods are inserted into said insertion slots of said connection pieces to form a frame;

a plurality of lateral rods, provided on sides of said frame;

a handle rack, located on a side of said frame, and is provided with an upper fixing stand and a lower fixing stand, such that said upper fixing stand is connected to two of said connection pieces on two sides through an upper lateral rod, and a lower lateral rod runs through said lower fixing stand, and is connected to two of said connection pieces on two sides, and a plurality of fastening pieces, used to sandwich and fasten said lateral rod between two of said round rods;

wherein each of said round rods is further sleeved with a fixing plate, an outer surface of said fixing plate is provided with a barb, and an inner surface of said fixing plate is provided with at least a positioning protrusion block; wherein a fastening slot is provided at said connection end of said connection pieces, and through fastening and connecting said barb with said fastening slot, said round rod and said connection piece are more stably connected; and wherein an outer surface of said round rod is provided with at least a positioning slot, hereby achieving position said round rod and said fixing plate through matching said positioning slot with said positioning protrusion block.

5. The fiberglass frame as claimed in claim 4, wherein two of said connection pieces on both sides of said lower fixing stand are provided with arc-shaped dent slots, that are used to accommodate rollers to rotate in said dent slots, and on other two of said connection pieces at a bottom plane are provided with footings.

6. The fiberglass frame as claimed in claim 4, wherein shape of said frame assembled is a cube, a cuboid, or an irregular shape.

* * * * *